US009274478B1

(12) United States Patent
Nuita

(10) Patent No.: US 9,274,478 B1
(45) Date of Patent: Mar. 1, 2016

(54) IMAGE FORMING APPARATUS AND MESSAGE DISPLAY METHOD FOR PRESENTING MULTIPLE STATUS CONDITIONS OF THE IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Akira Nuita, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/548,577

(22) Filed: Nov. 20, 2014

(51) Int. Cl.
*G03G 15/00* (2006.01)

(52) U.S. Cl.
CPC ..... *G03G 15/5016* (2013.01)

(58) Field of Classification Search
CPC ..... G03G 2215/00708; G03G 2215/00548; G03G 15/6511; G03G 15/6502; G03G 15/6558; G03G 15/5016
USPC ..... 399/23, 18, 16, 388, 393, 396
See application file for complete search history.

(56) References Cited

U.S. PATENT DOCUMENTS

| | | | | |
|---|---|---|---|---|
| 7,487,048 | B2 * | 2/2009 | Morisaki | B65H 7/06 399/10 |
| 2001/0017992 | A1 * | 8/2001 | Hayashi et al. | 399/68 |
| 2003/0038419 | A1 * | 2/2003 | Kawai | B65H 3/0661 271/18 |
| 2009/0057984 | A1 * | 3/2009 | Matsumoto | 271/10.03 |

FOREIGN PATENT DOCUMENTS

| | | | | |
|---|---|---|---|---|
| JP | 09150989 | A * | 6/1997 | B65H 7/06 |

* cited by examiner

*Primary Examiner* — Billy Lactaoen
(74) *Attorney, Agent, or Firm* — Amin, Turocy & Watson, LLP

(57) ABSTRACT

In accordance with one embodiment, an image forming apparatus comprises a paper pickup section configured to pick up paper from a cassette; a calculating section configured to measure the time from the moment the paper is picked up to the moment the conveyance of the paper is detected by a sensor arranged at a given distance away from the paper pickup section, to calculate a delay time with respect to a specified time; and a control section configured to count the number of times the calculated delay time exceeds a delay time stored in a storage section in which a plurality of delay times different in length are stored, and output message information different from each other according to the length of the calculated delay time and the counted times when a plurality of paper is fed.

14 Claims, 5 Drawing Sheets

| DISPLY PATTERN | CONDITION | OCCURRENCE TIMES | DISPLAY CONTENT |
|---|---|---|---|
| 1 | Δ T>Δ T1ms | 1~2 | PLEASE GET PREPARED TO CLEAN PICKUP ROLLER AND PAPER FEED ROLLER |
| 2 | Δ T>Δ T1ms | MORE THAN 3 | PLEASE CLEAN PICKUP ROLLER AND PAPER FEED ROLLER |
| 3 | Δ T>Δ T2ms | 1~2 | NEAR END OF SERVICE LIFE OF PICKUP ROLLER AND PAPER FEED ROLLER. RECOMMEND TO EXCHANGE |
| 4 | Δ T>Δ T2ms | MORE THAN 3 | END OF SERVICE LIFE OF PICKUP ROLLER AND PAPER FEED ROLLER. PLEASE EXCHANGE. COPY SPEED IS DECREASED TO xxCPM |
| 5 | Δ T>Δ T3ms | MORE THAN 2 | END OF SERVICE LIFE OF PICKUP ROLLER AND PAPER FEED ROLLER. PLEASE EXCHANGE. NOTE OCCURRENCE OF JAM. COPY SPEED IS DECREASED TO yyCPM |

| DISPLY PATTERN | CONDITION | OCCURRENCE TIMES | DISPLAY CONTENT |
|---|---|---|---|
| 1 | Δ T>Δ T1ms | 1~2 | PLEASE GET PREPARED TO CLEAN PICKUP ROLLER AND PAPER FEED ROLLER |
| 2 | Δ T>Δ T1ms | MORE THAN 3 | PLEASE CLEAN PICKUP ROLLER AND PAPER FEED ROLLER |
| 3 | Δ T>Δ T2ms | 1~2 | NEAR END OF SERVICE LIFE OF PICKUP ROLLER AND PAPER FEED ROLLER. RECOMMEND TO EXCHANGE |
| 4 | Δ T>Δ T2ms | MORE THAN 3 | END OF SERVICE LIFE OF PICKUP ROLLER AND PAPER FEED ROLLER. PLEASE EXCHANGE. COPY SPEED IS DECREASED TO xxCPM |
| 5 | Δ T>Δ T3ms | MORE THAN 2 | END OF SERVICE LIFE OF PICKUP ROLLER AND PAPER FEED ROLLER. PLEASE EXCHANGE. NOTE OCCURRENCE OF JAM. COPY SPEED IS DECREASED TO yyCPM |

FIG.3

IMAGE FORMING APPARATUS AND MESSAGE DISPLAY METHOD FOR PRESENTING MULTIPLE STATUS CONDITIONS OF THE IMAGE FORMING APPARATUS

FIELD

Embodiments described herein relate generally to an image forming apparatus which notifies the exchange time of a paper feed roller and a pickup roller for picking up paper from a paper feed cassette, and a message display method in the image forming apparatus.

BACKGROUND

Conventionally, in an image forming apparatus, paper picked up from a paper feed cassette is conveyed to an image forming section to form an image on the paper. A pickup roller for picking up the paper from the paper feed cassette is arranged in the paper feed cassette. Further, a paper feed roller is arranged nearby the pickup roller.

Incidentally, the paper picking up operation and the paper conveyance operation of the pickup roller and the paper feed roller slow down at the end of their service lives. Thus, the number of the paper picked up from the paper feed cassette is counted, and when the count value reaches a preset number, a message asking for the exchange of the pickup roller and the paper feed roller is displayed on a display section.

Further, conventionally, there is an example in which a sensor is arranged at a distance from the paper feed cassette, and the time from the moment the paper feeding operation is started to the moment the paper is detected by the sensor is measured. In this example, it is determined that the service life is to end if the detected time delays many times with respect to a preset time.

However, the conventional apparatus only asks for the exchange when it is determined that the service life is to end according to the number of the used paper and the like, and no useful information is provided.

BRIEF DESCRIPTION OF THE DRAWINGS

FIG. 3 is an illustration diagram illustrating the display content of a message according to the embodiment;

DETAILED DESCRIPTION

Figure 1:
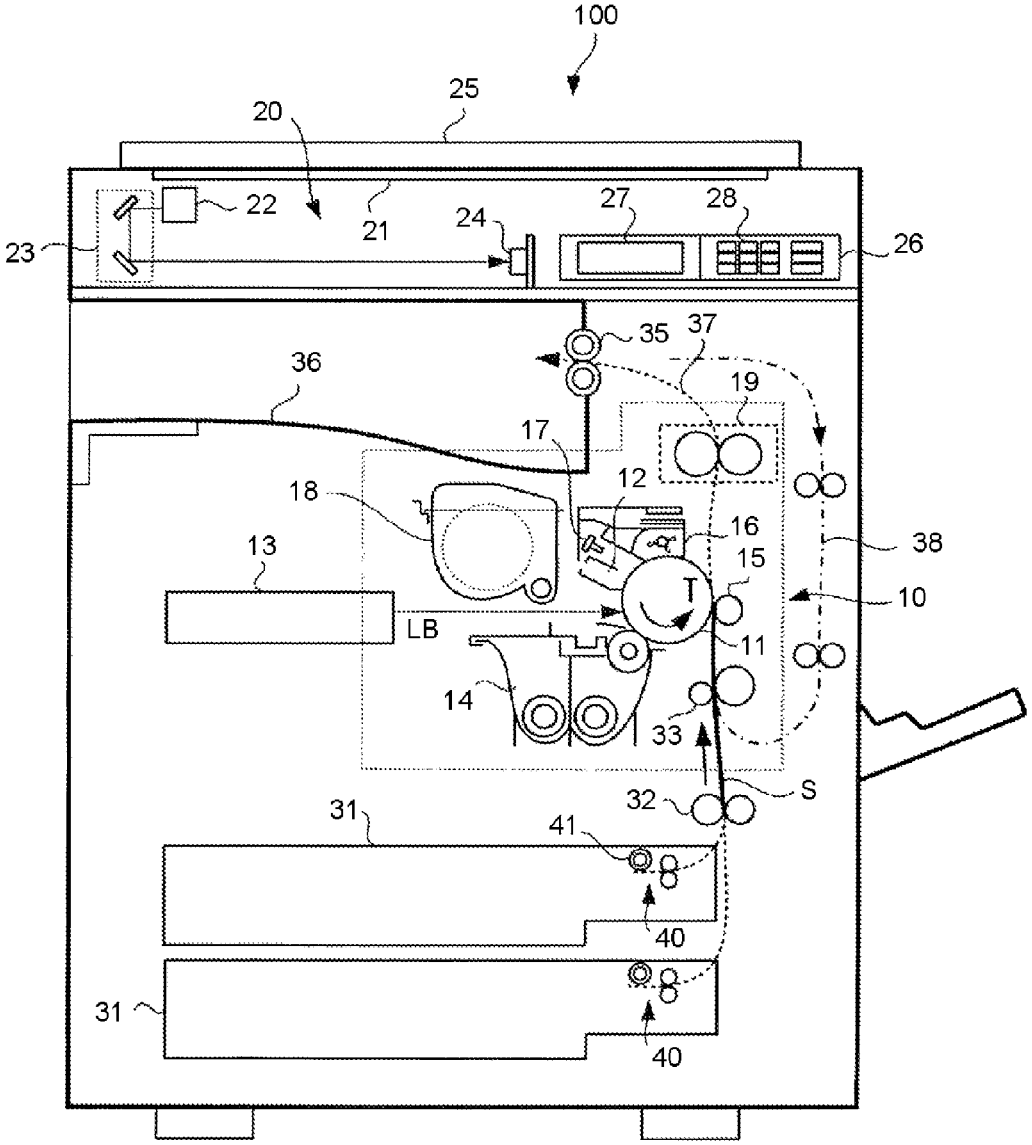
FIG. 1 is a diagram illustrating the constitution of an image forming apparatus according to one embodiment.

In accordance with one embodiment, an image forming apparatus comprises a paper pickup section configured to pick up paper from a cassette; a calculating section configured to measure the time from the moment the paper is picked up to the moment the conveyance of the paper is detected by a sensor arranged at a given distance away from the paper pickup section, to calculate a delay time with respect to a specified time; a storage section configured to store a plurality of delay times different in length; a control section configured to count the number of times the delay time calculated by the calculating section exceeds the delay time stored in the storage section, and output message information different from each other according to the length of the calculated delay time and the counted times when a preset number of paper is fed; and a display section configured to display the message information.

Hereinafter, the image forming apparatus according to one embodiment is described in detail with reference to the accompanying drawings. In addition, the same components are indicated by the same reference numerals in the drawings and repetitive description is not provided.

A First Embodiment

FIG. 1 is a diagram illustrating the constitution of the image forming apparatus according to the embodiment. In FIG. 1, an image forming apparatus 100 is, for example, an electrophotographic type copier. In addition to the copier, a printer, a multi-function peripheral (MFP) and the like may also be used as the image forming apparatus 100, however, the copier is exemplified in the following description.

The image forming apparatus (copier) 100 is provided with a printer section 10 at the center thereof. The printer section 10 includes a rotatable photoconductive drum 11. The photoconductive drum 11 serving as an image carrier includes an organic photo conductor (OPC) at the outer peripheral surface thereof. The photoconductive drum 11 is irradiated with light in a state of being applied with a given potential. The potential of the area of the photoconductive drum 11 irradiated with the light is changed. The photoconductive drum 11 maintains the change of the potential as an electrostatic latent image for a given time.

An electrostatic charger 12, an exposure unit 13, a developing device 14, a transfer roller 15, a drum cleaner 16 and a charge removing LED 17 are arranged around the photoconductive drum 11 along a rotation direction T of the photoconductive drum 11.

The electrostatic charger 12 charges the surface of the photoconductive drum 11 to a given potential. The exposure unit 13 irradiates the photoconductive drum 11 with a laser beam LB to expose the photoconductive drum 11. Through the exposure processing, the electrostatic latent image is formed on the surface of the photoconductive drum 11. The light intensity of the laser beam LB varies according to image density.

The developing device 14 stores two-component developing agent including toner and carrier. The developing device 14 supplies developing agent to the surface of the photoconductive drum 11 to develop the electrostatic latent image on the photoconductive drum 11. The electrostatic latent image on the surface of the photoconductive drum 11 is visualized to form a toner image. The transfer roller 15 applies a given potential to the paper S serving as an image receiving medium. The transfer roller 15 transfers the toner image on the photoconductive drum 11 to the paper S.

The drum cleaner 16 removes and collects the toner left on the surface of the photoconductive drum 11. The charge removing LED 17 removes the charge left on the photoconductive drum 11. Further, a fixing device 19 is arranged at the downstream side of the transfer roller 15. The fixing device 19 conveys the paper S, and meanwhile heats and presses the paper S at a given temperature. The toner image is fixed on the paper S by the fixing device 19.

A developing agent cartridge 18 for housing toner and developing agent is arranged above the developing device 14. After the toner and the developing agent in the developing device 14 are consumed, the toner and the developing agent are supplied from the developing agent cartridge 18 to the developing device 14.

Further, a scanner section 20 is arranged at the upper portion of the image forming apparatus 100. The scanner section 20 includes a light source 22, a reflecting mirror 23 and an image sensor 24. The light source 22 irradiates the document placed on a document placing table 21 with light. The reflecting mirror 23 reflects the light reflected from the document. The image sensor 24 receives the light reflected from the reflecting mirror 23.

A document cover 25 is arranged at the upper portion of the document placing table 21 in an openable manner. An operation panel 26 is arranged nearby the scanner section 20. The operation panel 26 includes a touch panel type display section 27 and operation keys 28.

A paper feed cassette 31 is arranged at the lower portion of the image forming apparatus 100. A plurality of paper feed cassettes may be arranged according to the paper size. The paper S in the paper feed cassette 31 is picked up by a pickup roller 41. The picked up paper S is guided to a transfer roller 15 by a conveyance roller 32 and a register roller 33. The pickup roller 41 picks up the paper S in the paper feed cassette 31 one by one. The conveyance roller 32 aligns the positions of the paper S and the toner image formed on the photoconductive drum 11. The conveyance roller 32 rotates at given timing to convey the paper S to the transfer position. The paper S passing through the transfer roller 15 is conveyed to the fixing device 19. The paper S passing through the fixing device 19 is discharged to a paper discharge tray 36 by a paper discharge roller 35.

In the present embodiment, the paper S is conveyed from the paper feed cassette 31 to the paper discharge tray 36. Thus, the side of the paper feed cassette 31 is defined as the upstream side in the paper conveyance direction. The side of the paper discharge tray 36 is defined as the downstream side in the paper conveyance direction.

In a case of simplex printing, the paper S is conveyed from the register roller 33 to the transfer roller 15. Then the paper S is conveyed through a conveyance path 37 from the transfer roller 15 to the fixing device 18 and the paper discharge roller 35. Further, a reversal conveyance path 38 is arranged to be used in a case of duplex printing. In a case of duplex printing, the paper S is temporarily conveyed from the paper discharge roller 35 towards the paper discharge tray 36. Then the paper S is switched back and conveyed to the reversal conveyance path 38. The reversal conveyance path 38, which is provided with a plurality of conveyance rollers, reverses and guides the paper S to the register roller 33.

When forming an image, the document on the document placing table 21 is irradiated with the light from the light source 22. The light reflected from the document is reflected by the reflecting mirror 23 to the image sensor 24, in this way, the document image is read. The laser beam LB is output from the exposure unit 13 based on the information read by the image sensor 24. Further, the laser beam LB is output from the exposure unit 13 based on the image information sent from an external device such as a PC (Personal Computer) and the like. The surface of the photoconductive drum 11 is irradiated with the laser beam LB. The surface of the photoconductive drum 11 is charged to negative polarity by the electrostatic charger 12. The photoconductive drum 11 is exposed by emitting the laser beam LB from the exposure unit 13. In this way, the electrostatic latent image is formed on the surface of the photoconductive drum 11.

Then the paper S taken out from the paper feed cassette 31 is conveyed to the transfer roller 15. The toner image on the photoconductive drum 11 is transferred to the paper S by the transfer roller 15. The paper S to which the toner image is transferred is conveyed to the fixing device 19. The paper S is heated and pressed by the fixing device 19 to fix the image on the paper S. The paper S on which the image is fixed is discharged to the paper discharge tray 36 through the paper discharge roller 35.

Figure 2:
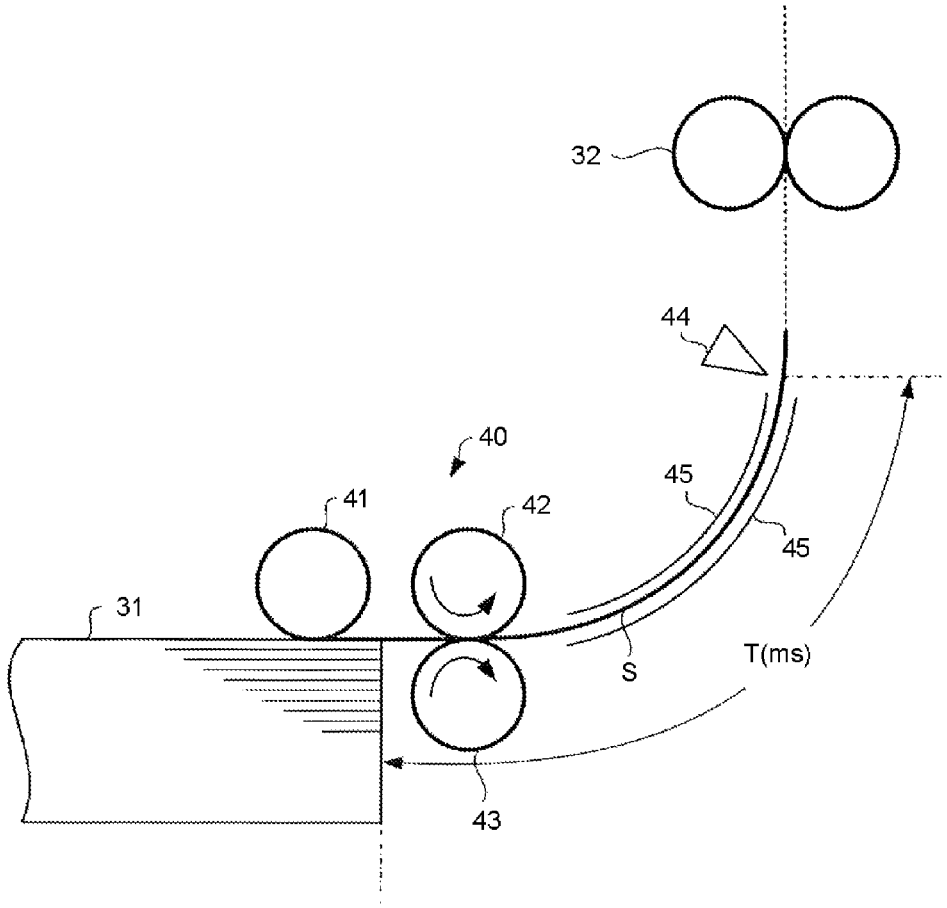
FIG. 2 is a diagram illustrating the constitution of a paper pickup section according to the embodiment.

FIG. 2 is a diagram illustrating the constitution of a paper pickup section 40 for picking up the paper S from the paper feed cassette 31. The paper pickup section 40 includes a pickup roller 41 for picking up the paper from the paper feed cassette 31. The paper pickup section 40 further includes paper feed rollers 42 and 43 for conveying the paper picked up by the pickup roller 41. The pickup roller 41 rotates in a state of being contacted with the paper in the paper feed cassette 31 to pick up the paper. The paper S picked up by the pickup roller 41 is conveyed to the paper feed rollers 42 and 43. The paper feed roller 43 separates one sheet of paper and feeds the paper to the subsequent stage in a case in which a plurality of sheets of paper is picked up by the pickup roller 41. The paper feed roller 43 is also referred to as a separation roller.

The paper feed rollers 42 and 43 are arranged opposite to each other. The paper feed rollers 42 and 43 are rotated to convey the paper to the conveyance roller 32. A sensor 44 for detecting the paper S is arranged at the downstream side of the paper feed rollers 42 and 43. Further, a guide 45 for supporting the conveyance of the paper is arranged at the downstream side of the paper feed rollers 42 and 43. The distance between the pickup roller 41 and the sensor 44 is a preset distance. That is, the sensor 44 is arranged at a given distance away from the paper pickup section 40.

In the embodiment, the paper is picked up by the pickup roller 41. The time when the front end of the paper conveyed by the paper feed rollers 42 and 43 is detected by the sensor 44 is measured by a timer 120. The timer 120 is arranged in a printer CPU 111 which is described later. The printer CPU 111 determines the exchange time of the pickup roller 41 and the paper feed rollers 42 and 43 based on the time measured by the timer 120. Further, in a case in which the time measured by the timer 120 delays with respect to a specified time T (ms), the printer CPU 111 switches the content of a message for asking for the exchange according to the delay time and the delay occurrence times.

That is, in a case in which the pickup roller 41 and the paper feed rollers 42 and 43 are in normal state, the time from the moment the pickup roller 41 starts to rotate to the moment the paper S is detected by the sensor 44 is set as the specified time T (ms).

In a case in which the pickup roller 41 and the paper feed rollers 42 and 43 are used many times and ware out, the conveyance of the paper slows down. As a result, the time from the moment the pickup roller 41 starts to rotate to the moment the paper S is detected by the sensor 44 delays with respect to the specified time T (ms).

Thus, the printer CPU 111 measures a delay time $\Delta T$ (ms) with respect to the specified time T (ins) for a preset number of times. For example, in a case in which ten sheets of paper S are conveyed continuously, the printer CPU 111 measures the delay time $\Delta T$ every time one sheet of paper is conveyed. Then the printer CPU 111 determines the display content of the message for asking for the exchange of the pickup roller 41 and the paper feed rollers 42 and 43 according to the level of the measured delay time $\Delta T$ and the delay occurrence times.

FIG. 3 is an illustration diagram illustrating the display content of the message generated by the printer CPU 111. In FIG. 3, display pattern is divided into five, and "condition", "occurrence times" and "display content" are regulated for each display pattern.

The condition indicates whether or not the delay time ΔT is greater than the preset delay time (ΔT1, ΔT2, ΔT3). In addition, the preset delay time (ΔT1, ΔT2, ΔT3) meets the following relation: ΔT1<ΔT2<ΔT3.

The condition 1 indicates a case in which the delay time ΔT is greater than the ΔT1 (ms) (ΔT>ΔT1). The condition 2 indicates a case in which the delay time ΔT is greater than the ΔT2 (ms) (ΔT>ΔT2). The condition 3 indicates a case in which the delay time ΔT is greater than the ΔT3 (ms) (ΔT>ΔT3).

The occurrence times indicate the number of times the delay corresponding to the condition occurs. For example, in a case in which ten sheets of paper are conveyed continuously, the printer CPU 111 counts the number of times the delay corresponding to the condition occurs. The display content indicates message information different from each other according to the condition and the occurrence times. The message information is output from the printer CPU 111 and displayed on the display section 27.

In FIG. 3, the display pattern 1 is described as an example. In the display pattern 1, the delay time ΔT exceeds the ΔT1 once or twice. At this time, a message "Please get prepared to clean pickup roller and paper feed roller" is displayed.

In the display pattern 2, the delay time ΔT exceeds the ΔT1 over three times. At this time, the display content is changed to a message "Please clean pickup roller and paper feed roller".

In the display pattern 3, the delay time ΔT exceeds the ΔT2 once or twice. At this time, the display content is changed to a message "Near end of service life of pickup roller and paper feed roller. Recommend to exchange."

In the display pattern 4, the delay time ΔT exceeds the ΔT2 over three times. At this time, the display content is changed to a message "End of service life of pickup roller and paper feed roller. Please exchange. Copy speed is decreased to xx CPM". In the display pattern 4, the paper feed speed is slow because it's the end of the service life of the pickup roller 41 and the paper feed rollers 42 and 43. More time is taken to feed paper and the copy speed is decreased, thus, it is displayed that the copy speed is slow.

Further, in the display pattern 5, the delay time ΔT exceeds the ΔT3 over twice. At this time, the display content is changed to a message "End of service life of pickup roller and paper feed roller. Please exchange. Copy speed is decreased to yy CPM. Note occurrence of jam".

The longer the delay time ΔT becomes, the closer the pickup roller 41 and the paper feed rollers 42 and 43 are to the end of the service life. Thus, the display content notifies in stages that the exchange time is approaching. That is, message information in which the exchange-requesting degree becomes higher as the exchange time approaches is output from the printer CPU 111. Ultimately, a message indicating that jam will occur if the rollers are not exchanged is displayed.

A user who reads the display content can be aware that it is near the end of service life of the pickup roller 41 and the paper feed rollers 42 and 43. The user can be aware of the current state of the pickup roller 41 and the paper feed rollers 42 and 43. The user can further be aware that the copy speed is gradually decreased as it is closer to the end of service life. Further, the user can be aware of the possibility of the occurrence of jam.

The user can exchange the pickup roller 41 and the paper feed rollers 42 and 43 in advance according to the display content. The exchange time can be set by the user to use the rollers until the end of service life. Even in a case of using the rollers until the end of service life, the information indicating the decrease of the copy speed and the possibility of occurrence of jam can be displayed on the display section 27. Thus, it is possible to display a message so that the pickup roller 41 and the paper feed rollers 42 and 43 are exchanged before it interferes with image formation processing.

Figure 4:
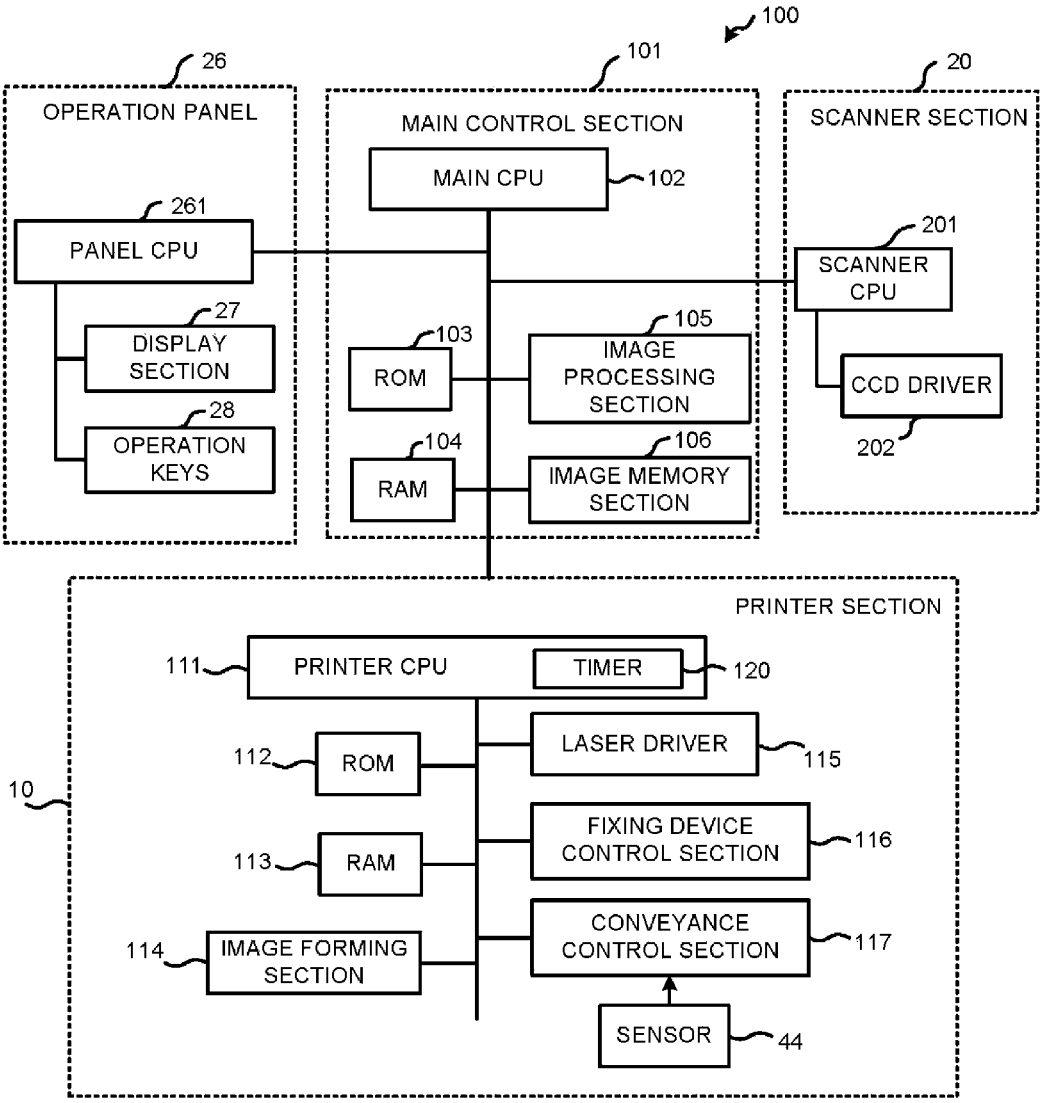
FIG. 4 is a block diagram illustrating the constitution of a control system of the image forming apparatus according to the embodiment.

FIG. 4 is a block diagram illustrating the constitution of a control system of the image forming apparatus 100 according to the embodiment. In FIG. 4, the image forming apparatus 100 includes a main control section 101, the operation panel 26, the scanner section 20 and the printer section 10. The control system of the image forming apparatus 100, which includes a plurality of CPUs such as a main CPU 102 of the main control section 101, a panel CPU 261 of the operation panel 26, a scanner CPU 201 of the scanner section 20 and a printer CPU 111 of the printer section 10, carries out communication between each CPU.

The main control section 101 includes the main CPU 102, an ROM 103, an RAM 104, an image processing section 105, an image memory section 106 such as an HDD, and the like. The main CPU 102 controls the whole operations of the image forming apparatus 100. The ROM 103 stores control programs and the like. The RAM 104 temporarily stores data when the main CPU 102 carries out various kinds of processing.

The image processing section 105 processes the image data read by the scanner section 20 and the image data sent from a PC and the like. The image data processing includes, for example, image conversion processing for enlarging/reducing an image.

Further, the image memory section 106 stores the image data read by the scanner section 20 and the image data (file data, drawn image data and the like) sent from a PC and the like in a compressed manner. The image data stored in the image memory section 106 is input to the image processing section 105 to carry out various kinds of image processing. The image data subjected to the image processing is printed on the paper by the printer section 10.

The operation panel 26 includes the panel CPU 261 connected with the main CPU 102, the display section 27 including a liquid crystal screen and the like, and various operation keys 28. The display section 27 has a touch panel function, and instructions on the paper size, printing magnification, simplex printing, duplex printing and the like are input through the display section 27. Further, the message indicating the display content shown in FIG. 3 is displayed on the display section 27. The operation keys 28 include numeric keys for instructing the number of printings and the like.

The scanner section 20 includes a CCD driver 202 for driving the image sensor. The CCD driver 202 drives the image sensor to read the image of the document and convert the image into the image data.

The printer section 10 includes the printer CPU 111, an ROM 112, an RAM 113, an image forming section 114, a laser driver 115, a fixing device control section 116, a conveyance control section 117 and the like. The printer section 10 carries out printing on the paper through cooperation with the main control section 101 on the basis of the control of the printer CPU 111. The printer CPU 111 includes the timer 120.

The ROM 112 stores, for example, a program for controlling the printer section 10 and the like. The RAM 113 serving as a storage section temporarily stores data when the printer CPU 111 carries out various kinds of processing. The RAM 113 further stores the data of the delay time ΔT1, ΔT2 and ΔT3 described above.

The printer CPU 111 controls the image forming section 114. The image forming section 114 controls the photoconductive drum 11, the electrostatic charger 12, the developing device 14, the transfer roller 15 and the like to form an image. The laser driver 115 drives the laser of the exposure unit 13.

The fixing device control section 116 controls a heating roller of the fixing device 19. The fixing device control section 116 controls the temperature of the heating roller of the fixing device 19.

The conveyance control section 117 controls the pickup roller 41 and the paper feed rollers 42 and 43 on the basis of the control of the printer CPU 111 to control the paper feed processing. Further, the conveyance control section 117 controls motors (not shown) for driving the transfer roller 15, the conveyance roller 32, the register roller 33, the paper discharge roller 35 and the like to control the conveyance of the paper S.

Further, a detection result from the sensor 44 is input to the conveyance control section 117. The detection result from the sensor 44 is sent to the printer CPU 111 from the conveyance control section 117. The timer 120 of the printer CPU 111 measures the time from the moment the pickup roller 41 starts to rotate to the moment the paper S is detected by the sensor 44. The printer CPU 111 calculates the delay time ΔT (ms) in a case in which the measured time delays with respect to the specified time T (ms). That is, the conveyance control section 117 and the printer CPU 111 constitute a calculating section which measures the time from the moment the paper S is picked up to the moment the conveyance of the paper S is detected by the sensor 44 to calculate the delay time with respect to the specified time.

Further, the printer CPU 111 outputs the message information asking for the exchange of the pickup roller 41 and the paper feed rollers 42 and 43 on the basis of the information such as the calculated delay time, the delay occurrence times and the like. That is, the printer CPU 111 constitutes a control section for outputting the message information. The message information is sent to and displayed on the display section 27.

Figure 5:
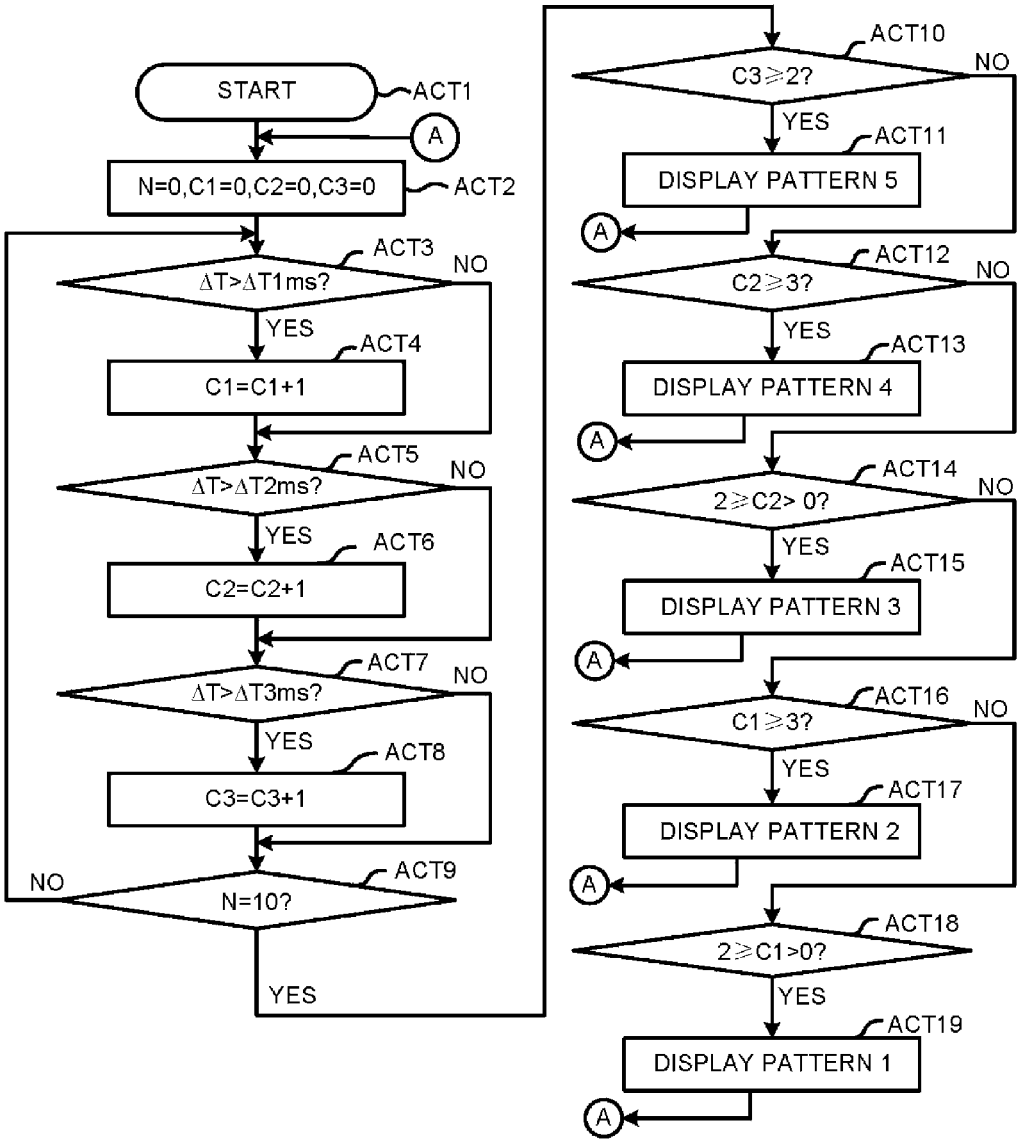
FIG. 5 is a flowchart illustrating an operation of displaying the message according to the embodiment.

FIG. 5 is a flowchart illustrating an operation of displaying the message corresponding to the measurement result of the delay time T. The operation shown in FIG. 5 is carried out on the basis of the control of the printer CPU 111 (hereinafter referred to as CPU 111 simply).

In FIG. 5, the determination operation of the delay time ΔT is started in ACT 1. The CPU 111 sets the paper feed times N to 0 (that is, N=0) in ACT 2. In ACT 2, the CPU 111 further sets the number of times C1 that the calculated delay time ΔT exceeds the ΔT1 to 0 (that is, C1=0). Similarly, the CPU 111 sets the number of times C2 that the calculated delay time ΔT exceeds the ΔT2 to 0 (that is, C2=0). The CPU 111 sets the number of times C3 that the calculated delay time ΔT exceeds the ΔT3 to 0 (that is, C3=0).

In ACT 3, the CPU 111 compares the calculated delay time ΔT with the delay time ΔT1 stored in the RAM 113. The CPU 111 determines whether or not the delay time ΔT exceeds the ΔT1 on the basis of the comparison result. In a case in which ΔT>ΔT1 (YES in ACT 3), ACT 4 is taken. In ACT 4, the CPU 111 increases the C1 by 1 (that is, C1=C1+1). In a case in which it is determined to be NO in ACT 3, the CPU 111 carries out the processing in ACT 5.

In ACT 5, the CPU 111 compares the calculated delay time ΔT with the delay time ΔT2 stored in the RAM 113. The CPU 111 determines whether or not the delay time ΔT exceeds the ΔT2 on the basis of the comparison result. In a case in which ΔT>ΔT2 (YES in ACT 5), ACT 6 is taken. In ACT 6, the CPU 111 increases the C2 by 1 (that is, C2=C2+1). In a case in which it is determined to be NO in ACT 5, ACT 7 is taken.

In ACT 7, the CPU 111 compares the calculated delay time ΔT with the delay time ΔT3 stored in the RAM 113. The CPU 111 determines whether or not the delay time ΔT exceeds the ΔT3 on the basis of the comparison result. In a case in which ΔT>ΔT3 (YES in ACT 7), ACT 8 is taken. In ACT 8, the CPU 111 increases the C3 by 1 (that is, C3=C3+1). In a case in which it is determined to be NO in ACT 7, the CPU 111 carries out the processing in ACT 9.

In ACT 9, the CPU 111 determines whether or not the number N of fed paper reaches ten. In a case in which it is determined to be NO in ACT 9, the processing in ACT 3 is carried out again. The CPU 111 repeats the processing from ACT 3 to ACT 8 until N=10. In a case in which it is determined to be YES in ACT 9, ACT 10 is taken.

In ACT 10, the CPU 111 determines whether or not the count value of C3 is equal to or greater than 2. In a case in which C3≥2, ACT 11 is taken. In ACT 11, the CPU 111 outputs the message information corresponding to the display pattern 5 shown in FIG. 3. The message corresponding to the display pattern 5 is displayed on the display section 27. In a case in which it is determined to be NO in ACT 10, ACT 12 is taken.

In ACT 12, the CPU 111 determines whether or not the count value of C2 is equal to or greater than 3. In a case in which C2≥3, ACT 13 is taken. In ACT 13, the CPU 111 outputs the message information corresponding to the display pattern 4 shown in FIG. 3. The message corresponding to the display pattern 4 is displayed on the display section 27. In a case in which it is determined to be NO in ACT 12, ACT 14 is taken.

In ACT 14, the CPU 111 determines whether or not the count value of C2 is 1 or 2. In a case in which 2≥C2>0, ACT 15 is taken. In ACT 15, the CPU 111 outputs the message information corresponding to the display pattern 3 shown in FIG. 3. The message corresponding to the display pattern 3 is displayed on the display section 27. In a case in which it is determined to be NO in ACT 14, ACT 16 is taken.

In ACT 16, the CPU 111 determines whether or not the count value of C1 is equal to or greater than 3. In a case in which C1≥3, ACT 17 is taken. In ACT 17, the CPU 111 outputs the message information corresponding to the display pattern 2 shown in FIG. 3. The message corresponding to the display pattern 2 is displayed on the display section 27. In a case in which it is determined to be NO in ACT 16, ACT 18 is taken.

In ACT 18, the CPU 111 determines whether or not the count value of C1 is 1 or 2. In a case in which 2≥C1>0, ACT 19 is taken. In ACT 19, the CPU 111 outputs the message information corresponding to the display pattern 1 shown in FIG. 3. The message corresponding to the display pattern 1 is displayed on the display section 27.

After the processing in ACT 11, ACT 13, ACT 15, ACT 17 and ACT 19 is carried out, the processing in ACT 2 is carried out again. The CPU 111 repeats the processing from ACT 2 to ACT 19 until the user takes an action corresponding to the message.

In accordance with the image forming apparatus according to the embodiment described above, it is possible to notify the user that it is near the end of service life of the pickup roller 41 and the paper feed rollers 42 and 43. Further, it is possible to ask the user to exchange the rollers accurately by changing the display content.

In addition, the present invention is not limited to the embodiment described above, and various applications are possible. For example, the displayed message is not limited to the description above, and a graph may be displayed to ask for the exchange. Further, it is exemplified in FIG. 3 that the display pattern is divided into five parts, and the display content of each display pattern is different from one another; however, the display pattern may be divided into more or less than five parts. The settings of the condition and occurrence times in FIG. 3 are only described as one example, and the contents may be set more finely.

The embodiment may be applied to an image forming apparatus different from the image forming apparatus shown in FIG. 1. For example, the apparatus may be a quadruple tandem image forming apparatus provided with a plurality of developing units for different colors. Further, a scanning head including LED elements may be used instead of the exposure unit 13 including the laser light source.

Furthermore, it is exemplified that the printer section 10 operates through the cooperation with the main CPU 102, and the conveyance control section 117 controls the paper feeding operation on the basis of the control of the printer CPU 111; however, the conveyance of the paper may be controlled by one single control section (for example, the main CPU 102). Moreover, the ROM 112 and the RAM 113 may be substituted with the ROM 103 and the RAM 104 of the main control section 101.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a paper pickup section configured to pick up paper from a cassette;

a calculating section configured to measure the time from the moment the paper is picked up to the moment the conveyance of the paper is detected by a sensor arranged at a given distance away from the paper pickup section, to calculate a delay time with respect to a specified time;

a storage section configured to store a plurality of preset delay times different in length;

a control section configured to count a number of occurrences in which the delay time calculated by the calculating section exceeds each preset delay time of the plurality of preset delay times stored in the storage section, and output message information based on which of the plurality of preset delay times is exceeded and the number of occurrences with respect to the exceeded preset delay time; and a display section configured to display the message information.

2. The apparatus of claim 1, wherein the control section outputs message information asking for the cleaning or exchange of a pickup roller and a paper feed roller arranged in the paper pickup section according to the counted times and the calculated delay time.

3. The apparatus of claim 1, wherein the control section outputs message information indicating a higher degree of requesting the exchange of the pickup roller and the paper feed roller in a case in which the counted times and the length of the calculated delay time increase.

4. The apparatus of claim 3, wherein the control section outputs message information indicating the decrease of a copy speed in a case in which the counted times and the length of the calculated delay time increase.

5. The apparatus of claim 3, wherein the control section outputs message information indicating the occurrence of jam in a case in which the counted times and the length of the calculated delay time increase.

6. The apparatus of claim 1, wherein the control section compares the delay time calculated when a preset number of paper is fed continuously with the preset delay time stored in the storage section, and counts the number of times the calculated delay time exceeds the stored delay time.

7. A message display method in an image forming apparatus, including:

measuring the time from the moment paper is picked up to the moment the conveyance of the paper is detected by a sensor arranged at a given distance away from a paper pickup section for picking up the paper from a cassette;

calculating a delay time with respect to a specified time on the basis of the measured time;

counting a number of occurrences in which the calculated delay time exceeds a preset delay time stored in a storage section in which a plurality of preset delay times different in length are stored;

outputting message information based on which of the plurality of preset delay times is exceeded and the number of occurrences with respect to the exceeded preset delay time; and displaying the message information on a display section.

8. The method of claim 7, wherein the message information asking for the cleaning or exchange of a pickup roller and a paper feed roller arranged in the paper pickup section is output according to the counted times and the calculated delay time.

9. The method of claim 7, wherein the message information indicating a higher degree of requesting the exchange of the pickup roller and the paper feed roller is output in a case in which the counted times and the length of the calculated delay time increase.

10. The method of claim 9, wherein the message information indicating the decrease of a copy speed or the occurrence of jam is output in a case in which the counted times and the length of the calculated delay time increase.

11. The apparatus of claim 1, wherein the plurality of preset delay times consists of three preset delay times.

12. The apparatus of claim 1, wherein the message information expresses one of at least three possible messages.

13. The method of claim 7, wherein the plurality of preset delay times consists of three preset delay times.

14. The method of claim 7, wherein the message information expresses one of at least three possible messages.

* * * * *